US005707737A

United States Patent [19]

Mori et al.

[11] Patent Number: 5,707,737

[45] Date of Patent: Jan. 13, 1998

[54] CELLULOSE ACETATE FIBER HAVING NON-CIRCULAR CROSS SECTION, MULTI-FILAMENTS THEREOF, AND PROCESS FOR THE PRODUCTION THEREOF

[75] Inventors: Hiroyuki Mori, Ibaraki; Kenkichi Nose, Osaka, both of Japan

[73] Assignee: Teijin Limited, Osaka, Japan

[21] Appl. No.: 750,830

[22] PCT Filed: Apr. 30, 1996

[86] PCT No.: PCT/JP96/01187

§ 371 Date: Dec. 19, 1996

§ 102(e) Date: Dec. 19, 1996

[87] PCT Pub. No.: WO96/35010

PCT Pub. Date: Nov. 7, 1996

[30] Foreign Application Priority Data

| | | | |
|---|---|---|---|
| May 1, 1995 | [JP] | Japan | 7-128822 |
| Aug. 11, 1995 | [JP] | Japan | 7-205807 |
| Dec. 19, 1995 | [JP] | Japan | 7-330524 |

[51] Int. Cl.[6] ..... D01F 2/30; D01D 1/02; D01D 5/04; D01D 5/253

[52] U.S. Cl. ..... 428/397; 106/170.47; 106/170.51; 106/170.53; 106/171.1; 264/177.13; 264/177.14; 264/211; 428/398; 428/400

[58] Field of Search ..... 106/170.47, 170.51, 106/170.53, 171.1; 264/177.13, 177.14, 211; 428/397, 398, 400

[56] References Cited

U.S. PATENT DOCUMENTS

| | | | |
|---|---|---|---|
| 4,276,173 | 6/1981 | Kell et al. | 210/500.2 |
| 4,543,221 | 9/1985 | Chen et al. | 264/41 |
| 5,236,474 | 8/1993 | Schofield et al. | 95/47 |
| 5,458,963 | 10/1995 | Meirowitz et al. | 428/400 |

FOREIGN PATENT DOCUMENTS

| | | |
|---|---|---|
| 37-7917 | 7/1962 | Japan . |
| 48-17485 | 5/1973 | Japan . |
| 60-134012 | 7/1985 | Japan . |
| 63-19335 | 5/1988 | Japan . |
| 3-59105 | 3/1991 | Japan . |
| 126817 | 4/1992 | Japan . |
| 146109 | 5/1994 | Japan . |
| 2152871 | 8/1985 | United Kingdom . |

*Primary Examiner*—James C. Cannon
*Attorney, Agent, or Firm*—Wenderoth, Lind & Ponack

[57] ABSTRACT

A cellulose acetate fiber excellent in gloss and feeling, formed from a mixture which consists essentially of (a) 100 parts by weight of cellulose acetate and (b) 5 to 40 parts by weight of a polymer substance which can plasticize the cellulose acetate, wherein, in a cross-sectional form at right angles with the lengthwise direction of the fiber, (i) the cross-sectional form is non-circular, (ii) the cross-sectional form has 1 to 4 axes of symmetry, and (iii) the cross-sectional form has a contour formed of smooth curves or formed of smooth curves and straight lines.

The above cellulose acetate fiber can be produced by dry-spinning a spinning dope consisting essentially of (a) 100 parts by weight of cellulose acetate, (b) 5 to 40 parts by weight of a polymer substance which is soluble in solvent and can plasticize the cellulose acetate, and (c) a solvent which can dissolve the above (a) and (b).

16 Claims, 7 Drawing Sheets

CELLULOSE ACETATE FIBER HAVING NON-CIRCULAR CROSS SECTION, MULTI-FILAMENTS THEREOF, AND PROCESS FOR THE PRODUCTION THEREOF

TECHNICAL FIELD OF THE INVENTION

The present invention relates to a cellulose acetate fiber which has a non-circular cross-sectional form having a contour formed of smooth curves or formed of smooth curves and straight lines; multi-filaments thereof; a spinning dope for the production thereof; and a process for the production of the fibers.

More specifically, it relates to a cellulose acetate fiber of which the cross section is non-circular, uniform in form and almost free of creases; multi-filaments thereof; a spinning dope for the production thereof; and a process for the production of the fibers.

Prior Art

A cellulose acetate fiber (to be also referred to as "acetate fiber" hereinafter) has excellent color-developing properties and a dry feeling, and exhibits its excellent properties as a material for fashionable clothing. In recent years, however, consumers' needs for textiles are upscaled and diversified, and it is therefore desired to improve the cellulose acetate fiber further.

An acetate fiber is formed by dry spinning in which a spinning dope prepared by dissolving acetate flakes as a source material in a solvent such as acetone or methylene chloride is spun through a spinneret and the solvent is evaporated in a spinning cylinder. Therefore, even if the spinning dope is spun through circular spinning orifices of the spinneret, the acetate fiber has cross sections having a number of concavo-convex forms or creases at a step where it is taken up in the form of yarns. It is presumed that the above takes place for the following reason. When yarns are dried in the spinning cylinder, exterior portions of the yarns are first dried to form skins, and then, the solvent inside is removed by evaporation to allow the first-formed skin portions to partially dent into the inside and form concavo-convex forms or creases.

Conventionally, methods of devising the spinneret have been conducted as means of altering the cross-sectional form of an acetate fiber.

For example, in Japanese Patent Publication No. 37-7917, an attempt is made to spin a spinning dope through a spinneret having triangle- or square-shaped orifices. In Japanese Laid-open Patent Publication No. 60-134012, a plurality of spinning orifices having specific cross-sectional forms are provided at specific intervals to obtain an acetate fiber having Y-shaped cross-section. In Japanese Laid-open Patent Publication No. 3-59105, an attempt is made to obtain a cross-sectionally hollow acetate fiber with a dual-tube type spinneret in which an inner tube is projected beyond an end surface of an outer spinneret and the diameter and the length of a spinning portion are adjusted to be in specific ranges.

Since, however, the above prior art techniques employ dry spinning basically, the drying state of a solvent cannot be altered in any attempt and it is difficult to form yarns of which the concave portions and convex portions are uniform in number and hence, it is impossible to prevent the inclusion of filaments which are non-uniform in cross-section and are considerably deviated from an intended form.

Problems to be Solved by the Invention

It is a first object of the present invention to provide an acetate fiber having a non-circular cross sectional form, i.e., a hetero-cross sectional form, the non-circular cross-sectional form having a contour formed of smooth curves or formed of smooth curves and straight lines, which have not been obtained by the conventional spinning methods.

It is a second object of the present invention to provide an acetate fiber whose cross-sectional form has a contour substantially free of creases and small dents and which is therefore excellent in gloss and feeling.

It is a third object of the present invention to provide acetate fiber multi-filaments which are relatively uniform and nearly substantially the same in cross-sectional form and whose cross sections have contours formed of smooth curves or formed of smooth curves and straight lines when the multi-filaments are produced through a spinneret having orifices having the same form.

It is another object of the present invention to provide a spinning dope for the production of an acetate fiber or its multi-filaments which achieve the above first to third objects.

It is further another object of the present invention to provide a process for the production of an acetate fiber or its multi-filaments which achieves the above first to third objects.

Means to Solve the Problems

According to the studies of the present inventors, the above objects of the present invention can be achieved by a cellulose acetate fiber formed from a mixture which consists essentially of (a) 100 parts by weight of cellulose acetate and (b) 5 to 40 parts by weight of a polymer substance which can plasticize the cellulose acetate, wherein, in a cross-sectional form at right angles with the lengthwise direction of the fiber, (i) the cross-section is non-circular, (ii) the cross-section has 1 to 4 axes of symmetry, and (iii) the cross-section has a contour formed of smooth curves or formed of smooth curves and straight lines.

Further, according to the studies of the present inventors, the above another object of the present invention can be achieved by a spinning dope consisting essentially of (a) 100 parts by weight of cellulose acetate, (b) 5 to 40 parts by weight of a polymer substance which is soluble in a solvent and can plasticize the cellulose acetate, and (c) a solvent which can dissolve the above (a) and (b).

Further, according to the present inventors, the above further another object of the present invention is achieved by a process for the production of a cellulose acetate fiber, which comprises extruding a spinning dope consisting essentially of (a) 100 parts by weight of cellulose acetate, (b) 5 to 40 parts by weight of a polymer substance which is soluble in a solvent and can plasticize the cellulose acetate, and (c) a solvent which can dissolve the above (a) and (b) through orifices of a spinneret to carry out dry-spinning.

As described already, the cross sectional form of the acetate fiber of the present invention has characteristic features in that (i) it has is non-circular in cross section, (ii) it has 1 to 4 axes of symmetry in cross section, and (iii) its contour is formed of smooth curves or formed of smooth curves and straight lines.

For easier understanding of the above characteristic features in cross section, the present invention will be explained with reference to schematic views shown in FIGS. 1 to 5. These five cross-sectional views in FIGS. 1 to 5 are typical embodiments, and the present invention shall not be limited thereto. These forms may be combined or partially altered.

Figure 1:
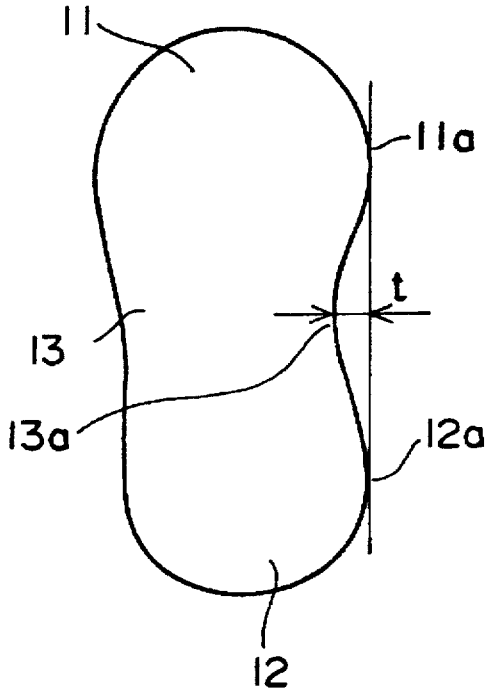
FIG. 1 is a schematic view showing the cross section of one filament of the cellulose acetate fiber of the present invention.
Figure 2:
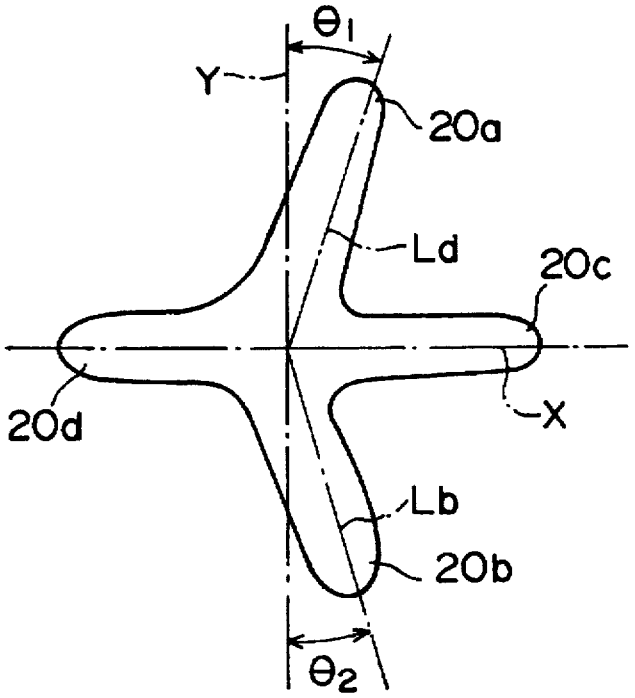
FIG. 2 is a schematic view showing the cross section of another cellulose acetate fiber filament of the present invention.
Figure 3:
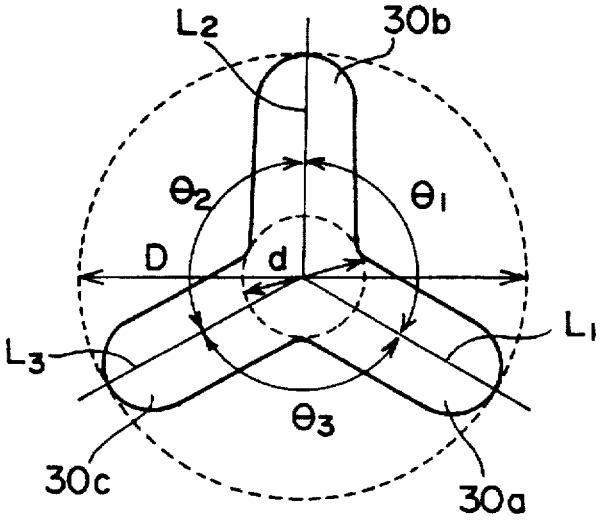
FIG. 3 is a schematic view showing the cross section of another cellulose acetate fiber filament of the present invention.
Figure 4:
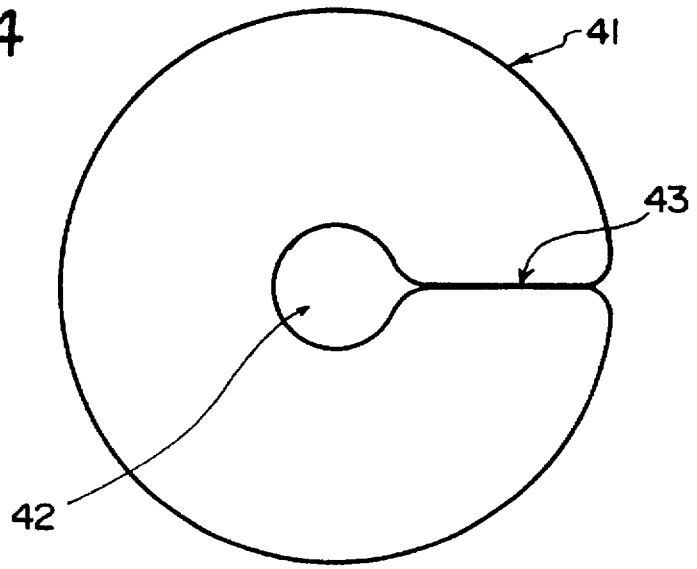
FIG. 4 is a schematic view showing the cross section of another cellulose acetate fiber filament of the present invention.
Figure 5:
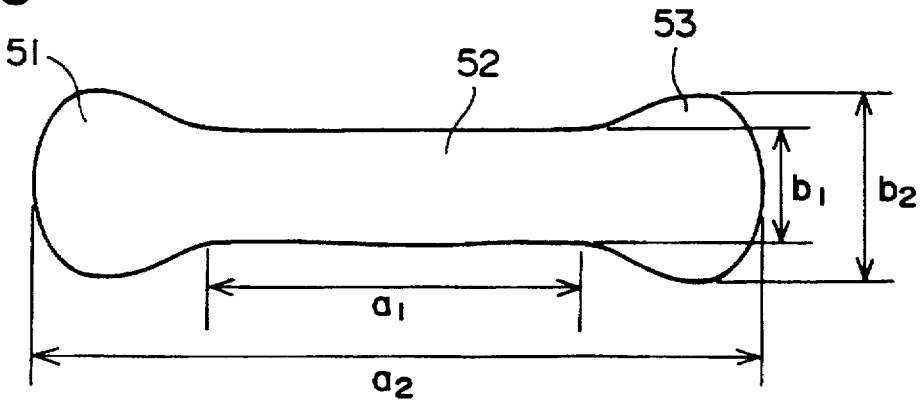
FIG. 5 is a schematic view showing the cross section of another cellulose acetate fiber filament of the present invention.

That is, FIG. 1 shows a cocoon-shaped cross sectional form, FIG. 2 shows a crisscross cross-sectional form, FIG. 3 shows a Y-letter-shaped cross-sectional form, FIG. 4 shows a C-letter-shaped cross-sectional form, and FIG. 5 shows an I-letter-shaped cross-sectional form.

As is understood from the schematic views in these FIGS. 1 to 5, the cross section of the acetate fiber of the present invention has a form having a contour formed of smooth curves or formed of smooth curves and straight lines. And, creases and small dents (sharp concaves) seen in cross section of a conventional acetate fiber are substantially not present, nor are sharp convex portions present.

Further, the cross section of the acetate fiber of the present invention has a characteristic feature in that it has 1 to 4 axes of symmetry. These axes of symmetry will be explained with reference to FIGS. 1 to 5. The form in FIG. 1 has 1 or 2 axes of symmetry, the crisscross form in FIG. 2 has 1 to 4 axes of symmetry (A nearly complete crisscross form has 4 axes of symmetry), the Y-letter-shaped form in FIG. 3 has 1 or 3 axes of symmetry, the C-letter-shaped form in FIG. 4 has 1 axis of symmetry, and the I-letter-shaped form in FIG. 5 has 1 or 2 axes of symmetry. In these cases, it should be understood that the symmetricalness is not necessarily required to be complete or that a tiny deviation or a tiny disagreement is allowable. The "tiny deviation" or "tiny disagreement" means that a difference in width or length with respect to the axis as a center is not more than 10%.

Further, the cross sections of the acetate fiber filaments of the present invention have a characteristic feature in that a number of filaments having uniform cross sections are aligned. For example, FIGS. 6, 8, 10, 12 and 14 are electron microscopic photographs of acetate fiber filaments of the present invention which were actually produced. As is understood from these electron microscopic photographs, one of characteristic features of the acetate fiber filaments of the present invention is that a relatively large number of filaments having the same cross-sectional forms are aligned.

Preferably at least about 50%, particularly preferably at least about 60%, of the filaments have the same cross-sectional forms, and the remainder has similar cross-sectional forms. The most preferably, at least about 70% of the filaments have nearly the same cross-sectional forms.

As for the cross section, the electron microscope photographs of FIGS. 6, 8, 10, 12 and 14 correspond to the schematic views of FIGS. 1, 2, 3, 4 and 5, respectively.

The acetate fiber having the above characteristic feature in cross-sectional form, provided by the present invention, cannot at all be obtained by a general method, i.e., a dry spinning method of spinning an acetate solution through a spinneret. Nor can the acetate fiber of the present invention be obtained by altering the form of each orifice of the spinneret.

The studies by the present inventors have revealed that an acetate fiber having the characteristic feature of the present invention in cross-sectional form can be obtained by mixing cellulose acetate with a predetermined amount of a polymer substance which can plasticize the cellulose acetate to prepare a solution and spinning the solution.

That is, the polymer substance (component b) which is to be mixed with cellulose acetate (component a) is properly those which can plasticize the cellulose acetate, preferably can compatibilize the cellulose acetate and is soluble in an solvent. It is assumed that the polymer substance as the component b works on cellulose acetate as a plasticizer and a compatibilizing agent.

Is not clear why an acetate fiber having the characteristic feature of the present invention in cross-sectional form is formed by incorporating the above polymer substance (component b), but the present inventors assume the following. That is, the formation of a fiber such as an acetate fiber by a dry spinning method depends upon the correlation between the rate of evaporation of a solvent on a fiber surface and the rate of diffusion of the solvent from the center of the fiber to the surface thereof.

That is, when the diffusion rate is grater than, or equivalent to, the evaporation rate of the solvent on the surface, the drying proceeds very uniformly, and when the fiber is spun through circular orifices, the cross section of each fiber filament is circular.

On the other hand, when the evaporation rate of the solvent is greater than the diffusion rate thereof, the outer surface portion is dried to form a skin. Further, as the remaining solvent is diffused through the skin to be evaporated out of the surface, the volume of interior of the fiber decreases to cause dents and creases on the skin. Finally, a number of concavo-convex forms are formed in the cross-section, and furthermore, the contour in cross-sectional form is non-uniform.

Generally, the diffusion rate of a solvent in a polymer depends mainly on the concentration of the solvent and the viscosity of the polymer. When the polymer substance (component b) which can plasticize cellulose acetate is added to, and mixed with, the cellulose acetate, as is done in the present invention, the viscosity of the polymer decreases and the diffusion rate of the solvent in the polymer increases.

As a result, presumably, the formation of a skin is deferred relatively, and the amount of the solvent which is evaporated after the skin formation decreases, whereby a cross section having the characteristic feature of the present invention is formed.

In the present invention, therefore, as the polymer substance (component b) which is to be mixed with the cellulose acetate (component a), it is desirable to be selected from those which can plasticize cellulose acetate and then compatibilize the plasticized cellulose acetate, and is soluble in a solvent. "Being soluble in a solvent" means that 5 to 40 parts by weight, per 100 parts by weight of the cellulose acetate (component a), of the polymer substance (component b) is soluble in the solvent which can dissolve the component a.

The cellulose acetate (component a) for forming the acetate fiber of the present invention is a cellulose acetate in which an average of 1 to 3 hydroxyl groups out of three hydroxyl groups present in a recurring unit of cellulose are converted to acetate ester groups, and particularly preferably is a cellulose acetate in which an average of 1.9 to 2.8 hydroxyl groups are converted to acetate ester groups (acetylation degree 47 to 60%).

The amount of the polymer substance (component b) to be incorporated is 5 to 40 parts by weight, preferably 7 to 35 parts by weight, particularly preferably 20 to 30 parts by weight, per 100 parts by weight of the cellulose acetate. When the amount of the component b is smaller than 5 parts by weight, undesirably, the number of fiber filaments having small dents and small creases in cross-sectional form increases. On the other hand, when the amount of the component b exceeds 40 parts by weight, the viscosity of the spinning dope extremely decreases to make it difficult to spin the fiber, and it is no longer possible to obtain the fiber by stable procedures.

Specific examples of the polymer substance as component b preferably include polyalkylene glycols (e.g., polyethylene glycol, polypropylene glycol and a polyethylene glycol-propylene glycol copolymer), polypropylenes, a polyethylene-propylene copolymer, and polyvinyl chloride.

The component b preferably has excellent compatibility with a solvent and is preferably a polymer substance having a solubility parameter (Sp value) which satisfies the following formula (1).

$$SP_s-1 \leq SP_p \leq SP_s+1 \quad (1)$$

wherein:

$SP_s$: Solubility parameter of solvent used, and $SP_p$: Solubility parameter of component b.

Namely, cellulose acetate has an SP value of 10.9, polyethylene glycol has an SP value of 9.9, polypropylene has an SP value of 9.2; polyvinyl chloride has an SP value of 10.8, and acetone as a solvent has an SP value of 10.0.

In general, the polymer substance as component b preferably has a solubility parameter ranging from 9 to 11.

As component b, polyethylene glycol is preferred. Above all, preferred is polyethylene glycol having a molecular weight of 700 to 25,000, and particularly preferred is polyethylene glycol having a molecular weight of 800 to 20,000.

The solvent is preferably selected from those solvents generally used for the dry-spinning of acetate fibers, and acetone and methylene chloride are particularly preferred. The solvent may contain a small amount of water.

In the present invention, suitably, the spinning dope has such a composition that the amount of solvent, per 20 to 40 parts by weight of the mixture containing the cellulose acetate (component a) and the polymer substance (component b) in the above-specified proportion, is 80 to 60 parts by weight, preferably that the amount of the solvent per 25 to 35 parts by weight of the mixture is 75 to 65 parts by weight.

In the production of the acetate fiber of the present invention, the above spinning dope containing the cellulose acetate (component a), the polymer substance (component b) and the solvent is prepared in advance and it is dry-spun under conditions of the production of general acetate fibers. In this case, the spinning dope is maintained at a temperature of 55° to 62° C., preferably 58° to 60° C. When the temperature of the spinning dope is lower than 55° C., the solvent in the spinning dope is not fully dried and the breakage of the fiber is caused. When the above temperature is higher than 62° C., the evaporation state of the solvent is no longer normal, the fiber having a desired cross-sectional form is no longer obtained, and the contour of the cross section is no longer uniform.

The method of preparing the spinning dope includes a method in which the polymer substance (component b) is added when the cellulose acetate (component a) is dissolved in the solvent or a method in which the component b is melted in advance and a predetermined amount of the molten component b is mixed with a spinning dope of the cellulose acetate to feed the mixture to a spinning machine.

The spinning conditions are not essentially different from those used for spinning a general acetate fiber. The draft ratio is properly in the range of from 1.1 to 1.4, and the take-up rate is preferably in the range of from 200 to 900 m/minute. The orifice form of the spinneret has an influence on the cross-sectional form as will be described later. It is therefore required to use a spinneret having the orifice form to be described later, for obtaining an acetate fiber having the corresponding cross section shown in any one of FIGS. 1 to 5.

With regard to typical examples of the non-circular cross-sectional form in the present invention, the features of the cross-sectional form and the orifice form of the spinneret for the production of a fiber having the cross-sectional form will be explained in detail.

A-1: Cocoon-shaped cross section (FIG. 1)

Figure 6:
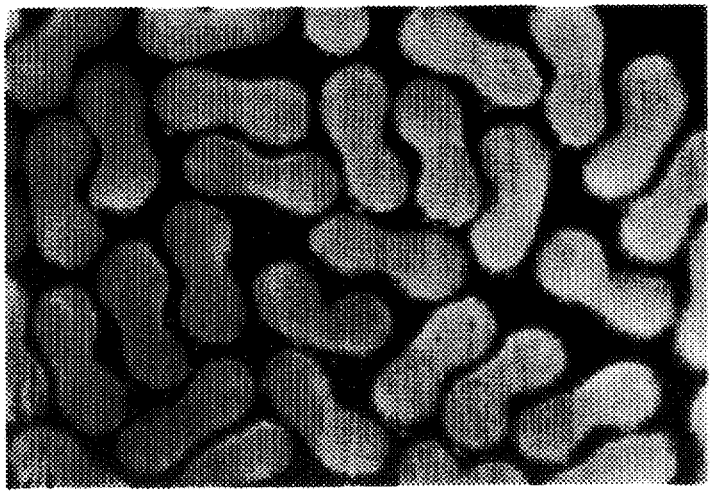
FIG. 6 is an electron microscopic photograph of the cross sections of cellulose acetate fiber filaments obtained in Example 7 of the invention(magnification: about 400×).

As shown in FIGS. 1 and 6, the cocoon-shaped cross-sectional form is composed of two round end portions 11 and 12 and a trunk portion 13 connecting these round end portions. A distance (depth) t between a tangent line connecting edges (11*a* and 12*a*) of these round end portions and a bottom portion (13*a*) is not more than 5 μm, preferably not more than 3 μm.

When the depth t exceeds 5 μm, the central portion (trunk portion) is narrow, and the fiber is creased so that the cocoon-shaped cross-sectional form can be no longer retained.

An acetate fiber having the above cocoon-shaped cross-sectional form is obtained by spinning it from the spinning dope through a circular orifice. In this case, suitably, the diameter of the circular orifice is 20 to 80 μm, preferably 30 to 70 μm.

A-2: Crisscross-shaped cross section (FIG. 2)

Figure 8:
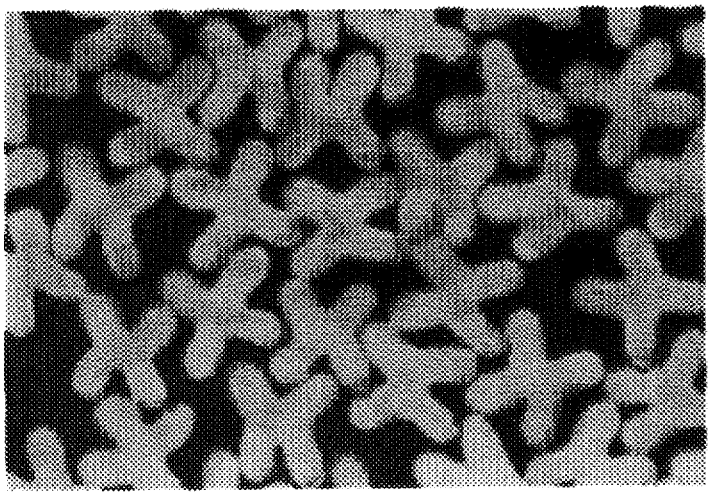
FIG. 8 is an electron microscopic photograph of the cross sections of cellulose acetate fiber filaments obtained in Example 11 (magnification: about 400×).

As shown in FIGS. 2 and 8, the crisscross-shaped cross-sectional form has a crisscross shape composed of 4 lobes. As shown in FIG. 2, in a nearly crisscross-shaped cross-sectional form composed of 4 lobes 20*a*, 20*b*, 20*c* and 20*d*, gradients θ of each lobe from two axes (X and Y) of symmetry [$\theta_1$ (angle formed by the central line of lobe 20*a* and the axis Y) and $\theta_2$ (angle formed by the central line of lobe 20*b* and the axis Y)] are not more than 30°, preferably not more than 15°. When the content of filaments having the above angle of greater than 30° in the entire filaments is 40% or more, a cloth is not improved in gloss and feeling.

In FIG. 2, the central lines of the lobes 20*c* and 20*d* are nearly in agreement with the axis X, and the angles formed by these central lines and the axis X are 0°.

In FIG. 2, the lobes 20*a* and 20*b* tilt to form angles $\theta_1$ and $\theta_2$ relative to the axis Y, while there is no limitation so long as the gradient of each of the 4 lobes is at least in a gradient range of not more than 30° relative to the axis of symmetry. In a preferred embodiment of the crisscross-shaped cross-sectional form, the axis X and the axis Y are at right angles with each other, and the central lines of the 4 lobes go over the axes X and Y, respectively. In this instance, there are 4 axes such as X axis, Y axis, an axis tilting at 45° from X axis and an axis tilting at 135° from X axis as axes of symmetry.

An acetate fiber having the above crisscross-shaped cross section can be produced through a spinneret having a nearly square orifice. Concerning the size of the square orifice, suitably, the length of each side is not more than 80 μm, preferably 50 to 70 μm.

A-3: Y-letter-shaped cross section (FIG. 3)

Figure 10:
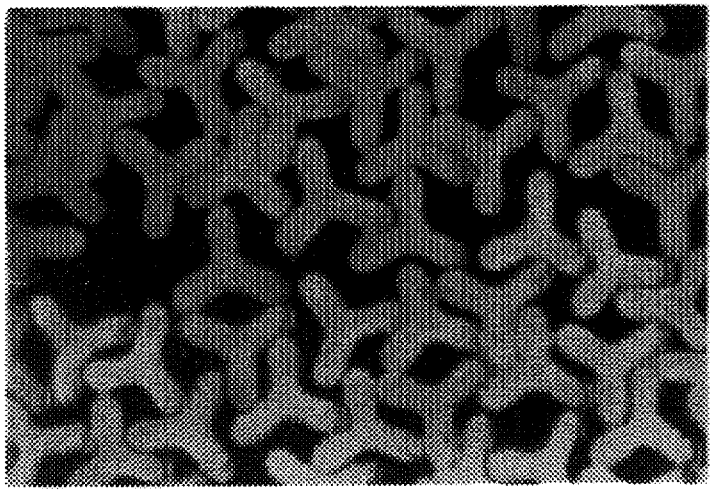
FIG. 10 is an electron microscopic photograph of the cross sections of cellulose acetate fiber filaments obtained in Example 19 (magnification: about 400×).

As shown in FIGS. 3 and 10, the Y-letter-shaped cross-sectional form is composed of 3 lobes.

That is, in FIG. 3, in the Y-letter-shaped sectional form having 3 lobes 30*a*, 30*b* and 30*c*, each of neighboring angles $\theta_1$, $\theta_2$ and $\theta_3$ formed by the two of neighboring central lines $L_1$, $L_2$ and $L_3$ of the lobes is 120°±10°. Further, in the Y-letter-shaped form, the ratio (D/d) of the diameter D of a circumscribed circle to the diameter d of an inscribed circle is preferably 3~5.

When the neighboring angles $\theta_1$, $\theta_2$ and $\theta_3$ and the diameter ratio (D/d) of a circumscribed circle and an inscribed circle concurrently satisfy the above values, there is obtained an acetate fiber having characteristic gloss and feeling.

An acetate fiber having the above Y-letter-shaped cross section can be produced through a spinneret having triangular orifices. Specifically, the length of each side of the triangle of the orifice is preferably not more than 80 μm, particularly preferably 50 to 70 μm.

A-4: C-letter-shaped cross section (FIG. 4).

Figure 12:
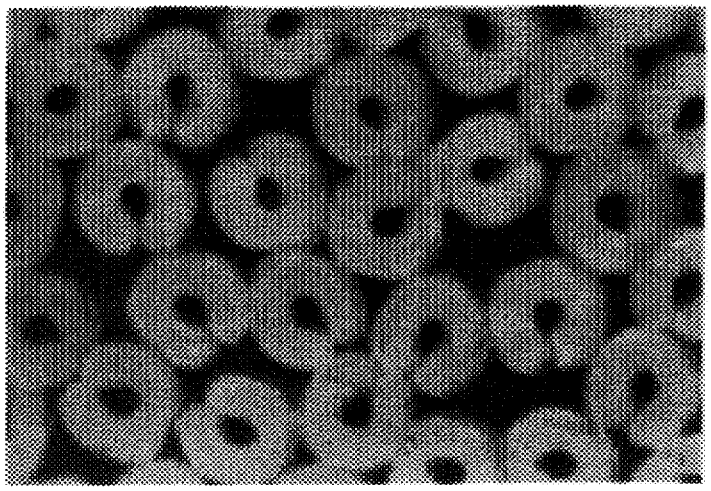
FIG. 12 is an electron microscopic photograph of the cross sections of cellulose acetate fiber filaments obtained in Example 28 (magnification: about 400×).

As shown in FIGS. 4 and 12, the C-letter-shaped cross-sectional form has a C-letter shape, in which each of end portions nearly bonds to the other and a hollow portion is formed. In the C-letter-shaped cross-sectional form, both the end portions (portion indicated by 43) of the C-letter shape bond to each other to form a hollow portion (42). The cross-sectional area of the hollow portion (42) is 5 to 15% of the cross-sectional area of a monofilament (41). The hollow portion (42) and the monofilament (41) are measured for cross-sectional areas with a planimeter according to a conventional method. When the hollow portion and the cross section of the monofilament are nearly circular, the calculation may be made on the basis of the measurement of diameters of a circumscribed circle and an inscribed circle.

An acetate fiber having the above C-letter-shaped cross section can be produced through a spinneret having orifices each of which is fan-shaped, the central angle of the fan being 220° to 260°, preferably 230° to 250°. Concerning the size of each of the fan-shaped orifices, the orifice diameter is 40 to 100 μm, preferably 60 to 80 μm.

A-5: I-letter-shaped cross-sectional form (FIG. 5)

Figure 14:
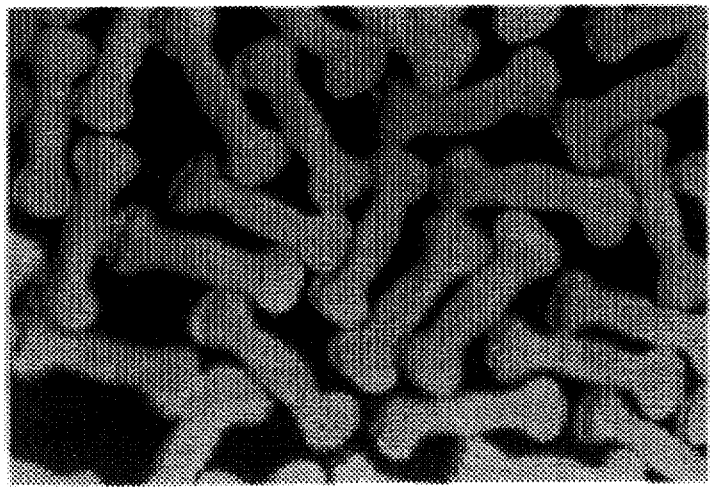
FIG. 14 is an electron microscopic photograph of the cross sections of cellulose acetate fiber filaments obtained in Example 38 (magnification: about 400×).

As shown in FIGS. 5 and 14, the I-letter-shaped cross-sectional form has two swelling end portions (51 and 53) having a form of an earlobe and a central narrow portion (52) formed of two straight lines. In the I-letter-shaped cross-sectional form, the length ratio ($L_1$) in the longitudinal direction, the length ratio ($L_2$) in the width direction and the length ratio ($L_3$) in the longitudinal and width directions are preferably in the following ranges.

($L_1$) Ratio of length ($a_1$) of central narrow portion and the total length ($a_2$) in the longitudinal direction: $a_2/a_1$= 1.5~2.5

($L_2$) Ratio of width ($b_1$) of central narrow portion and ($b_2$) of one which is the greater of the two swelling portions: $b_2/b_1$=1.5~2.5

($L_3$) Ratio of width ($b_1$) of central narrow portion and the total length ($a_2$) in the longitudinal direction: $a_2/b_1$= 2.5~8.0

When the ratio (b/a) of the length a of the central narrow portion and the total length b in the longitudinal direction, the ratio (d/c) of the width c of the central narrow portion and the width d of one which is the greater of the two swelling portions, and the ratio (b/c) of the width c of the central narrow portion and the total length b in the longitudinal direction satisfy the above values at the same time, there is obtained an acetate multi-filament yarn having novel characteristic gloss and feeling.

An acetate fiber having the above I-letter-shaped cross-sectional form can be produced through a spinneret having rectangular orifices.

Specifically, the length of each side of the rectangular orifice is preferably not more than 240 μm, particularly preferably 30 to 100 μm. Further, the length ratio of a larger side and a smaller side of the rectangle is preferably 1.4 to 4.0, particularly preferably 1.8 to 3.6.

In the cellulose acetate fiber having a non-circular (hetero-) cross section, provided by the present invention, the cross-sectional form is remarkably characteristic, the contour thereof is substantially free of dents and small creases and is also free of any sharp pointed end. The cellulose acetate fiber of the present invention is therefore excellent in feeling and gloss. In particular, the cellulose acetate fiber of which the cross section is crisscross, Y-letter-shaped or C-letter-shaped is particularly excellent in gloss and feeling, highly valuable in practical use and usable as a fiber material per se, and it can be also used as a mixture with other fiber.

The cellulose acetate fiber of the present invention has a monofilament denier (dpf) of 1 to 10 de, preferably 2 to 5 de, and multi-filaments thereof have a total denier (TLDe) of 30 to 300 de, preferably 50 to 150 de. The number of filaments (fil. count) is about 10 at 50 de, and it is about 30 at 300 de. Specifically, standard yarns (?) have 120 de/33 fil., 75 de/25 fil., 100 de/25 fil., 200 de/60 fil., or 300 de/100 fil.

EXAMPLES

The present invention will be explained more in detail with reference to Examples hereinafter, while the present invention shall not be limited to Examples below.

In Examples, various samples were evaluated as follows.

Cross Section Ratio

The proportion of the number of monofilaments as have a nearly cocoon-shaped cross-sectional form and a depth t, in a concave portion, of not more than 5 μm as is shown in FIG. 1 was shown by %.

Gloss

A hose-knitted fabric was prepared from the obtained acetate fiber (multi-filaments), an oil agent and polyethylene glycol were removed by refining, and then the fabric was visually evaluated for gloss. A sample in Comparative Example 8 was taken as standard (good), and a sample better than it was taken as excellent.

Feeling

A hose-knitted fabric treated in the same manner as in the gloss evaluation was evaluated by the feeling. A sample in Comparative Example 8 was taken as standard (good), and a sample which showed better bulkiness at dry touch was taken as excellent.

Hollow ratio

In the photograph of a cross section, a monofilament as shown in FIG. 4 was measured for cross-sectional areas of its hollow portion and its entirety, and the ratio of these was shown by %.

Hollow Monofilament Ratio

The ratio of the number of monofilaments having hollow portions which satisfied a predetermined hollow ratio to the total number of monofilaments was shown by %.

Examples 1–8 and Comparative Examples 1–6

31 Parts by weight of a mixture containing cellulose acetate flakes having an average acetylation degree of 54.7% and polyethylene glycol (PEG) in a mixing ratio shown in Table 1, 68 parts by weight of acetone and 1 part by weight of water were mixed and defoamed to prepare a homogeneous spinning dope.

The above spinning dope was dry-spun, with a dry spinning apparatus, under conditions shown in Table 1 through a spinneret having 33 circular spinning orifices having a diameter of 50 μm each at a draft ratio of 1.2 and a take-up rate of 700 m/minute while the temperature of the spinning dope at a spinning time was adjusted to a desired temperature, to give an acetate fiber having 120 denier/33 filaments. Table 1 shows the results.

Figure 7:
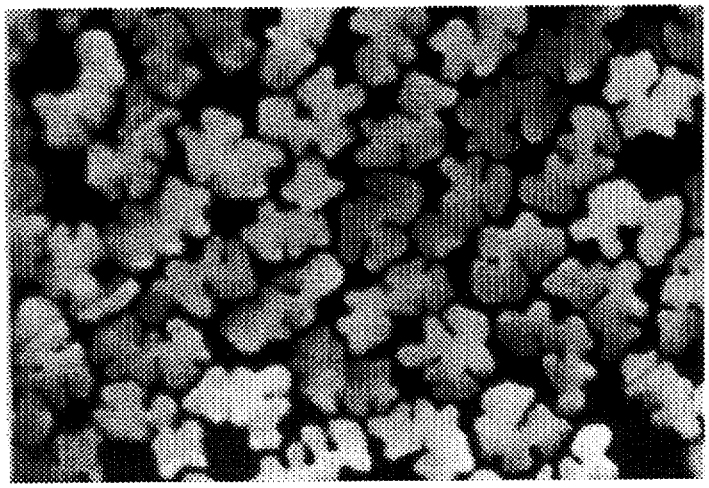
FIG. 7 is an electron microscopic photograph of the cross sections of cellulose acetate fiber filaments obtained in Comparative Example 4 (magnification: about 400×).

FIGS. 6 and 7 show electron microscopic photographs (magnification: 400×) of cross-sectional forms of the acetate fibers obtained in Example 7 and Comparative Example 4, respectively.

Comparative Examples 7–8

24 Parts by weight of cellulose acetate flakes having an average acetylation degree of 54.7%, 75 parts by weight of acetone and 1 part by weight of water were mixed and defoamed to prepare a homogeneous spinning dope.

The above spinning dope was dry-spun, with a dry spinning apparatus, under the conditions shown in Table 1 and under the same dry-spinning conditions as those in Example 1 through a spinneret having 33 circular spinning orifices having a diameter of 50 μm each while the temperature of the spinning dope at a spinning time was adjusted to a desired temperature, to give an acetate fiber having 120 denier/33 filaments. Table 1 shows the results.

TABLE 1

| | Molecular weight of poly-ethylene glycol | Amount ratio of PEG (wt %) | Temper-ature of spinning dope (°C.) | Cross section ratio (%) | Gloss | Feeling |
|---|---|---|---|---|---|---|
| CEx. 1 | 1,000 | 2.5 | 59 | 30 | Good | Good |
| Ex. 1 | " | 5 | " | 65 | Excellent | Excel-lent |
| Ex. 2 | " | 10 | " | 70 | " | Excel-lent |
| Ex. 3 | " | 25 | " | 90 | " | Excel-lent |
| Ex. 4 | " | 40 | " | 90 | " | Excel-lent |
| CEx. 2 | " | 25 | 65 | 30 | Good | Good |
| CEx. 3 | 20,000 | 2.5 | 59 | 25 | " | " |
| Ex. 5 | " | 5 | " | 65 | Excellent | Excel-lent |
| Ex. 6 | " | 10 | " | 75 | " | Excel-lent |
| Ex. 7 | " | 25 | " | 90 | " | Excel-lent |
| Ex. 8 | " | 40 | " | 90 | " | Excel-lent |
| CEx. 4 | " | 25 | 65 | 30 | Good | Good |
| CEx. 5 | " | " | 50 | Sinning failure | — | — |
| CEx. 6 | " | 50 | 59 | Sinning failure | — | — |
| CEx. 7 | — | — | 59 | 5 | Good | Good |
| CEx 8 | — | — | 65 | 5 | " | " |

Examples 9–16 and Comparative Examples 9–15

31 Parts by weight of a mixture containing cellulose acetate flakes having an average acetylation degree of 54.7% and polyethylene glycol (PEG) in a mixing ratio shown in Table 1, 68 parts by weight of acetone and 1 part by weight of water were mixed and defoamed to prepare a homogeneous spinning dope.

The above spinning solution was dry-spun, with a dry spinning apparatus, under conditions shown in Table 2 through a spinneret having 20 square spinning orifices having a side length of 68 μm each at a draft ratio of 1.3 and a take-up rate of 700 m/minute while the temperature of the spinning dope at a spinning time was adjusted to a desired temperature, to give an acetate fiber having 120 denier/33 filaments. Table 2 shows the results.

Figure 9:
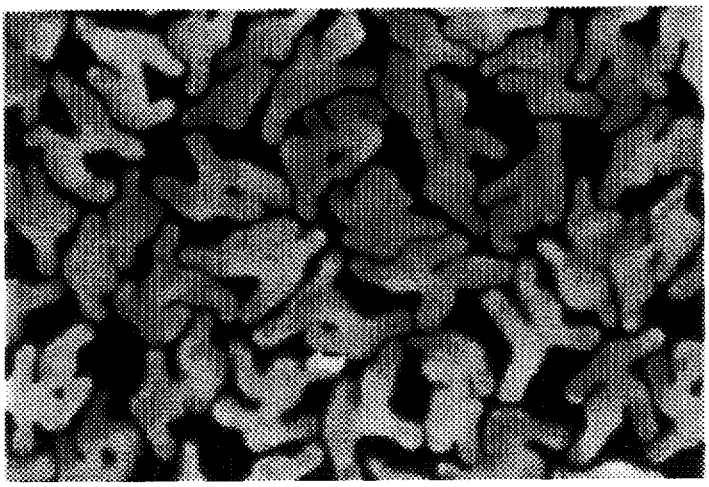
FIG. 9 is an electron microscopic photograph of the cross sections of cellulose acetate fiber filaments obtained in Comparative Example 15 (magnification: about 400×).

FIGS. 8 and 9 show electron microscopic photographs (magnification: 400×) of cross-sectional forms of the acetate fibers obtained in Example 11 and Comparative Example 15, respectively.

TABLE 2

| | Molecular weight of poly-ethylene glycol | Amount ratio of PEG (wt %) | Tempera-ture of spinning dope (°C.) | Cross section ratio (%) | Gloss | Feeling |
|---|---|---|---|---|---|---|
| CEx. 9 | 1,000 | 2.5 | 59 | 30 | Good | Good |
| Ex. 9 | " | 5 | " | 60 | Excellent | Excel-lent |
| Ex. 10 | " | 10 | " | 65 | " | Excel-lent |
| Ex. 11 | " | 25 | " | 70 | " | Excel-lent |
| Ex. 12 | " | 40 | " | 70 | " | Excel-lent |
| CEx. 10 | " | 25 | 65 | 40 | Good | Good |
| CEx. 11 | 20,000 | 2.5 | 59 | 15 | " | " |
| Ex. 13 | " | 5 | " | 60 | Excellent | Excel-lent |
| Ex. 14 | " | 10 | " | 65 | " | Excel-lent |
| Ex. 15 | " | 25 | " | 70 | " | Excel-lent |
| Ex. 16 | " | 40 | " | 77 | " | Excel-lent |
| CEx. 12 | " | 25 | 65 | 45 | Good | Good |
| CEx. 13 | " | " | 50 | Sinning failure | — | — |
| CEx. 14 | " | 50 | 59 | Sinning failure | — | — |
| CEx. 15 | — | — | 59 | 10 | Good | Good |

Examples 17–26 and Comparative Examples 16–19

31 Parts by weight of a mixture containing cellulose acetate flakes having an average acetylation degree of 54.7% and polyethylene glycol (PEG) in a mixing ratio shown in Table 3, 68 parts by weight of acetone and 1 part by weight of water were mixed and defoamed to prepare a homogeneous spinning dope.

The above spinning dope was dry-spun, with a dry spinning apparatus, under conditions shown in Table 3 through a spinneret having 20 triangular spinning orifices having a side length of 65 μm each at a desired take-up rate while the temperature of the spinning dope at a spinning time was adjusted to 59° C., to give an acetate fiber having 100 denier/20 filaments. Table 3 shows the results.

Comparative Examples 20–21

24 Parts by weight of cellulose acetate flakes having an average acetylation degree of 54.7%, 75 parts by weight of acetone and 1 part by weight of water were mixed and defoamed to prepare a homogeneous spinning dope.

The above spinning dope was dry-spun, with a dry spinning apparatus, under conditions shown in Table 3 and under the same dry-spinning conditions as those in Example 17 through a spinneret having 20 triangular spinning orifices having a side length of 65 μm each while the temperature of the spinning dope at a spinning time was adjusted to 65° C., to give an acetate fiber having 100 denier/20 filaments. Table 3 shows the results.

Figure 11:
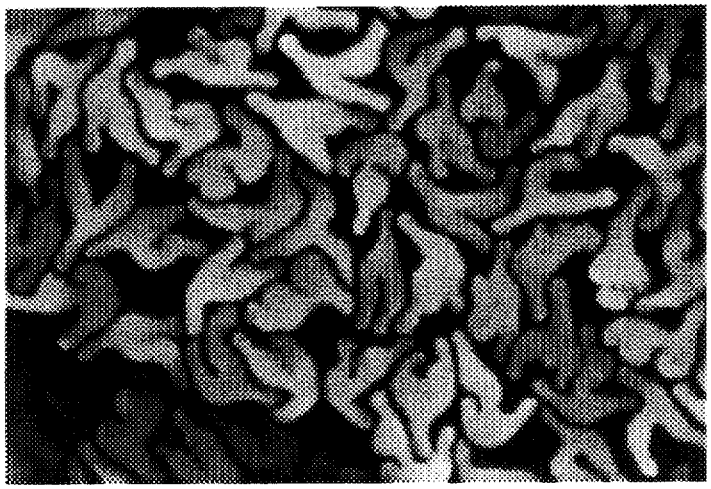
FIG. 11 is an electron microscopic photograph of the cross sections of cellulose acetate fiber filaments obtained in Comparative Example 20 (magnification: about 400×).

FIGS. 10 and 11 show electron microscopic photographs (magnification: 400×) of cross-sectional forms of the acetate fibers obtained in Example 19 and Comparative Example 20, respectively.

TABLE 3

| | Molecular weight of poly-ethylene glycol | Amount ratio of PEG (wt %) | Take-up rate (m/minute) | Cross section ratio (%) | Gloss | Feeling |
|---|---|---|---|---|---|---|
| CEx. 16 | 1,000 | 2.5 | 650 | 45 | Good | Good |
| Ex. 17 | " | 5 | " | 60 | Excellent | Excel-lent |
| Ex. 18 | " | 10 | " | 75 | " | Excel-lent |
| Ex. 19 | " | 25 | " | 93 | " | Excel-lent |
| Ex. 20 | " | 40 | " | 88 | " | Excel-lent |
| CEx. 17 | " | 50 | " | Spin-ning failure | — | — |
| CEx. 18 | 20,000 | 2.5 | 650 | 50 | Good | Good |
| Ex. 21 | " | 5 | 650 | 65 | Excellent | Excel-lent |
| Ex. 22 | " | 15 | 400 | 90 | " | Excel-lent |
| Ex. 23 | " | " | 650 | 88 | " | Excel-lent |
| Ex. 24 | " | " | 750 | 87 | " | Excel-lent |
| Ex. 25 | " | 25 | 650 | 95 | " | Excel-lent |
| Ex. 26 | " | 40 | " | 90 | " | Excel-lent |
| CEx. 19 | " | 50 | 400 | Spin-ning failure | — | — |
| CEx. 20 | — | — | 400 | 40 | Good | Good |
| CEx. 21 | — | — | 650 | 10 | Good | Good |

Examples 27–35 and Comparative Examples 22–27

31 Parts by weight of a mixture containing cellulose acetate flakes having an average acetylation degree of 54.7% and polyethylene glycol (PEG) in a mixing ratio shown in Table 4, 68 parts by weight of acetone and 1 part by weight of water were mixed and defoamed to prepare a homogeneous spinning dope.

The above spinning dope was dry-spun, with a dry spinning apparatus, under conditions shown in Table 4 through a spinneret having twenty fan-shaped orifices which had a diameter of 80 μm and a central angle of 240° each at a desired take-up rate while the temperature of the spinning dope at a spinning time was adjusted to 59° C., to give an acetate fiber having 100 denier/20 filaments. Table 4 shows the results.

Comparative Examples 28 and 29

24 Parts by weight of cellulose acetate flakes having an average acetylation degree of 54.7%, 75 parts by weight of acetone and 1 part by weight of water were mixed and defoamed to prepare a homogeneous spinning dope.

The above spinning dope was dry-spun, with a dry spinning apparatus, under conditions shown in Table 4 and under the same dry-spinning conditions as those in Example 27 through a spinneret having fan-shaped orifices which had a diameter of 80 μm and a central angle of 240° while the temperature of the spinning dope at a spinning time was adjusted to 65° C., to give an acetate fiber having 100 denier/20 filaments. Table 4 shows the results.

Figure 13:
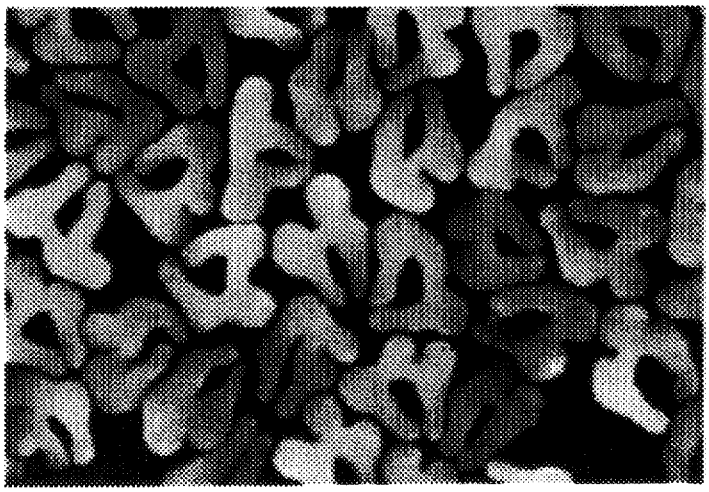
FIG. 13 is an electron microscopic photograph of the cross sections of cellulose acetate fiber filaments obtained in Comparative Example 26 (magnification: about 400×).

FIGS. 12 and 13 show electron microscopic photographs (magnification 400 diameters) of cross-sectional forms of the acetate fibers obtained in Example 28 and Comparative Example 26, respectively.

TABLE 4

| | Molecular weight of polyethylene glycol | Amount ratio of PEG (wt %) | Take-up rate (m/minute) | Hollow ratio (%) | Ratio of hollow monofilaments (%) | Gloss | Feeling |
|---|---|---|---|---|---|---|---|
| CEx. 22 | 1,000 | 2.5 | 650 | 3 | 45 | Good | Good |
| Ex. 26 | " | 5 | " | 6 | 65 | Excellent | Excellent |
| Ex. 27 | " | 10 | " | 7 | 70 | " | " |
| Ex. 28 | " | 25 | " | 9 | 90 | " | " |
| Ex. 29 | " | 40 | " | 11 | 95 | " | " |
| CEx. 23 | " | 50 | " | " | Spinning failure | " | " |
| CEx. 24 | 20,000 | 2.5 | 650 | 4 | 50 | Good | Good |
| Ex. 30 | " | 5 | 650 | 7 | 65 | Excellent | Excellent |
| Ex. 31 | " | 15 | 400 | 10 | 92 | " | " |
| Ex. 32 | " | " | 650 | 10 | 85 | " | " |
| Ex. 33 | " | " | 750 | 9 | 85 | " | " |
| Ex. 34 | " | 25 | 650 | 12 | 63 | " | " |
| Ex. 35 | " | 40 | " | 14 | 95 | " | " |
| CEx. 25 | " | 50 | 400 | — | Spinning failure | — | — |
| CEx. 26 | — | — | 400 | — | — | Good | Good |
| CEx. 27 | — | — | 650 | — | — | Good | Good |

Examples 36–45 and Comparative Examples 30–33

31 Parts by weight of a mixture containing cellulose acetate flakes having an average acetylation degree of 54.7% and polyethylene glycol (PEG) in a mixing ratio shown in Table 5, 68 parts by weight of acetone and 1 part by weight of water were mixed and defoamed to prepare a homogeneous spinning dope.

The above spinning dope was dry-spun, with a dry spinning apparatus, under conditions shown in Table 5 through a spinneret having 20 rectangular orifices which had a smaller side length of 40 μm and a longer side length of 80 μm each at a desired take-up rate while the temperature of the spinning dope at a spinning time was adjusted to 59° C., to give an acetate fiber having 100 denier/20 filaments. Table 5 shows the results.

Comparative Examples 34–35

24 Parts by weight of cellulose acetate flakes having an average acetylation degree of 54.7%, 75 parts by weight of acetone and 1 part by weight of water were mixed and defoamed to prepare a homogeneous spinning dope.

The above spinning dope was dry-spun, with a dry spinning apparatus, under conditions shown in Table 5 and under the same dry-spinning conditions as those in Example 1 through a spinneret having 20 rectangular orifices which had a smaller side length of 40 μm and a longer side length of 80 μm each while the temperature of the spinning dope at a spinning time was adjusted to 65° C., to give an acetate fiber having 100 denier/20 filaments. Table 5 shows the results.

Figure 15:
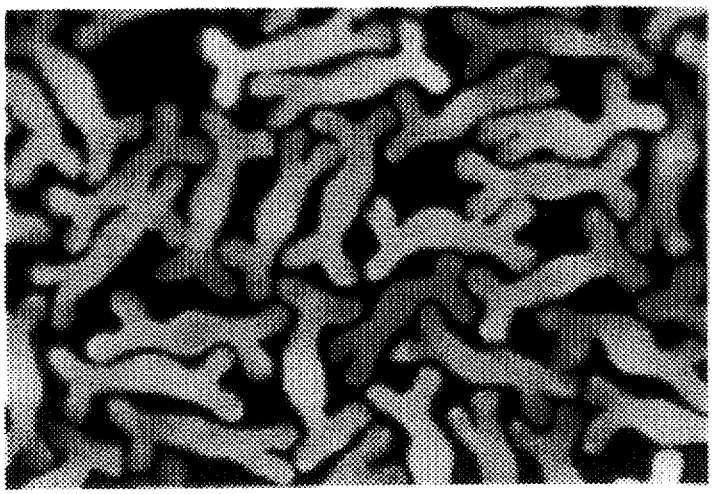
FIG. 15 is an electron microscopic photograph of the cross sections of cellulose acetate fiber filaments obtained in Comparative Example 34 (magnification: about 400×).

FIGS. 14 and 15 show electron microscopic photographs (magnification: 400×) of cross-sectional forms of the acetate fibers obtained in Example 38 and Comparative Example 34, respectively.

TABLE 5

| | Molecular weight of polyethylene glycol | Amount ratio of PEG (wt %) | Take-up rate (m/minute) | Cross section ratio (%) | Gloss | Feeling |
|---|---|---|---|---|---|---|
| CEx. 30 | 1,000 | 2.5 | 650 | 45 | Good | Good |
| Ex. 36 | " | 5 | " | 60 | Excellent | Excellent |
| Ex. 37 | " | 10 | " | 75 | " | Excellent |
| Ex. 38 | " | 25 | " | 90 | " | Excellent |
| Ex. 39 | " | 40 | " | 93 | " | Excellent |
| CEx. 31 | " | 50 | " | Spinning failure | — | — |
| CEx. 32 | 20,000 | 2.5 | 650 | 50 | Good | Good |
| Ex. 40 | " | 5 | 650 | 65 | Excellent | Excellent |
| Ex. 41 | " | 15 | 400 | 92 | " | Excellent |
| Ex. 42 | " | " | 650 | 84 | " | Excellent |
| Ex. 43 | " | " | 750 | 80 | " | Excellent |
| Ex. 44 | " | 25 | 650 | 90 | " | Excellent |
| Ex. 45 | " | 40 | " | 90 | " | Excellent |
| CEx. 33 | " | 50 | 400 | Spinning failure | — | — |
| CEx. 34 | — | — | 400 | 40 | Good | Good |
| CEx. 35 | — | — | 650 | 10 | Good | Good |

Examples 46 and 47

31 Parts by weight of a mixture containing cellulose acetate flakes having an average acetylation degree of 54.7% and 15% by weight, based on the cellulose acetate flakes, of polypropylene, 68 parts by weight of acetone and 1 part by weight of water were mixed and defoamed to prepare a homogeneous spinning dope.

The above spinning dope was dry-spun, with a dry spinning apparatus, under conditions shown in Example 22 through a spinneret having 20 triangular orifices which had a side length of 65 μm each at a draft ratio of 1.2 at a take-up rate of 700 m/minute while the temperature of the spinning dope at a spinning time was adjusted to a desired temperature, to give an acetate fiber having 100 denier/20 filaments.

The so-obtained filaments had a non-circular cross section ratio of 70% and was excellent in both gloss and feeling (Example 46).

On the other hand, an acetate fiber was obtained under the same conditions as above except that the polypropylene was replaced with polyvinyl chloride in the same amount.

The so-obtained filaments had a non-circular cross section ratio of 75% and was excellent in both gloss and feeling (Example 47).

We claim:

1. A cellulose acetate fiber formed from a mixture which consists essentially of (a) 100 parts by weight of cellulose acetate and (b) 5 to 40 parts by weight of a polymer substance which can plasticize the cellulose acetate, wherein, in a cross-sectional form at right angles with the lengthwise direction of the fiber, (i) the cross-sectional form is non-circular, (ii) the cross-sectional form has 1 to 4 axes of symmetry, and (iii) the cross-sectional form has a contour formed of smooth curves or formed of smooth curves and straight lines.

2. The cellulose acetate fiber of claim 1, wherein the polymer substance is compatible with the cellulose acetate.

3. The cellulose acetate fiber of claim 1, wherein the polymer substance is soluble in acetone or methylene chloride.

4. The cellulose acetate fiber of claim 1, wherein the polymer substance has a solubility parameter of 9 to 11.

5. The cellulose acetate fiber of claim 1, wherein the polymer substance is polyethylene glycol, polypropylene or polyvinyl chloride.

6. The cellulose acetate fiber of claim 1, wherein the cross-sectional form is free of small dents and small creases in its contour.

7. The cellulose acetate fiber of claim 1, wherein the cross-sectional form is cocoon-shaped, crisscross-shaped, Y-letter-shaped, C-letter-shaped or I-letter-shaped.

8. The cellulose acetate fiber of claim 1, wherein the cross-sectional form is crisscross-shaped, Y-letter-shaped or C-letter-shaped.

9. Cellulose acetate filaments at least 50% of which are formed of the cellulose acetate fiber recited in claim 1.

10. Cellulose acetate filaments at least 60% of which are formed of the cellulose acetate fiber recited in claim 1.

11. A spinning dope consisting essentially of (a) 100 parts by weight of cellulose acetate, (b) 5 to 40 parts by weight of a polymer substance which is soluble in solvent and can plasticize the cellulose acetate, and (c) a solvent which can dissolve the above (a) and (b).

12. The spinning dope of claim 11, wherein the polymer substance has a solubility parameter ($SP_p$) which satisfies the following formula, $$SP_s-1 \leqq SP_p \leqq SP_s+1$$

wherein:

$SP_s$: Solubility parameter of the solvent, and $SP_p$: Solubility parameter of the polymer substance.

13. The spinning dope of claim 11, wherein the polymer substance is a polyalkylene glycol, polypropylene or polyvinyl chloride.

14. The spinning dope of claim 11, wherein the solvent is acetone or methylene chloride.

15. A process for the production of a cellulose acetate fiber, which comprises dry-spinning the spinning dope recited in claim 11.

16. A process for the production of a cellulose acetate fiber, which comprises dry-spinning the spinning dope recited in claim 11 through a spinneret having a number of circular, square, triangular, fan-shaped or rectangular orifices.

* * * * *